United States Patent [19]

Forrest

[11] Patent Number: 4,809,584

[45] Date of Patent: Mar. 7, 1989

[54] MUSIC TRANSLATION DEVICE

[76] Inventor: David M. Forrest, 445 W. 49th St.-Apt. 5C, New York, N.Y. 10019

[21] Appl. No.: 70,452

[22] Filed: Jul. 7, 1987

[51] Int. Cl.[4] ..... A63J 17/00

[52] U.S. Cl. ..... 84/464 R; 340/815.11; 362/811

[58] Field of Search ..... 84/464 R, 464 A; 362/227, 363, 800, 806, 811; 340/815.11; 315/323

[56] References Cited

U.S. PATENT DOCUMENTS

| | | | |
|---|---|---|---|
| Re. 32,341 | 1/1987 | Smith | 84/464 R X |
| 3,949,350 | 4/1976 | Smith | 84/464 R X |
| 4,176,581 | 12/1979 | Stuyvenberg | 84/464 R |
| 4,256,009 | 3/1981 | Verduim et al. | 84/464 R |
| 4,264,845 | 4/1981 | Bodnarz | 362/806 X |
| 4,346,640 | 8/1982 | Zeno et al. | 84/464 R |
| 4,440,059 | 4/1984 | Hunter | 84/464 R |
| 4,563,933 | 1/1986 | Kim | 84/464 A |

*Primary Examiner*—W. B. Perkey

*Attorney, Agent, or Firm*—Wolder, Gross & Yavner

[57] ABSTRACT

A music translation device provides a light output pattern in response to an audio input. A divider circuit is used to provide a repeating output which commutates repeatedly among a series of output lines. Each output line is connected to a pair of output devices. The output pairs are arranged along a pair of paths, the output devices being oriented along the lines in an opposed order to create the illusion of oppositely directed motion along the paths.

6 Claims, 3 Drawing Sheets

MUSIC TRANSLATION DEVICE

BACKGROUND OF THE INVENTION

The present invention relates to a new and improved apparatus for the conversion of audio signals, and preferably music, to an output light pattern.

There have been numerous devices developed to provide a visual output which in one way or another corresponds to an audio input. When used as an entertainment device, such units, generally called "color organs", normally provide a multi-color, pulsating display whose design, intensity and/or color composition varies in time with the frequency and tempo of the music source. Such a device is exemplified by U.S. Pat. Re. No. 32,341 of Jan. 27, 1987 to R. M. Smith.

The present invention is similarly of the general type in which an audio signal is utilized to control a visual display. The present invention, however, utilizes a new and unique form of visual display which provides effects substantially different from that of the prior art.

BRIEF DESCRIPTION OF THE INVENTION

In accordance with the present invention, a music translation device is disclosed in which the audio output from an appropriate source, such as a cassette player, is amplified and utilized as the input to a divider circuitry means. Such divider circuitry means allows for an output to be sequentially placed on a plurality of output lines, the commutation rate of such output being dependent upon the amplitude and frequency of the audio source. Each output line is associated with a pair of discrete display units, the respective first and second display units being aligned in an opposed order along a pair of rows, whereby the created display, taken in conjunction with the music, has a positive effect on the viewer.

BRIEF DESCRIPTION OF THE DRAWINGS

A fuller understanding of the present invention will be obtained upon consideration of the following detailed description of a preferred, but nonetheless illustrative embodiment of the present invention when taken in conjunction with the annexed drawings, wherein.

DESCRIPTION OF A PREFERRED EMBODIMENT

Figure 1:
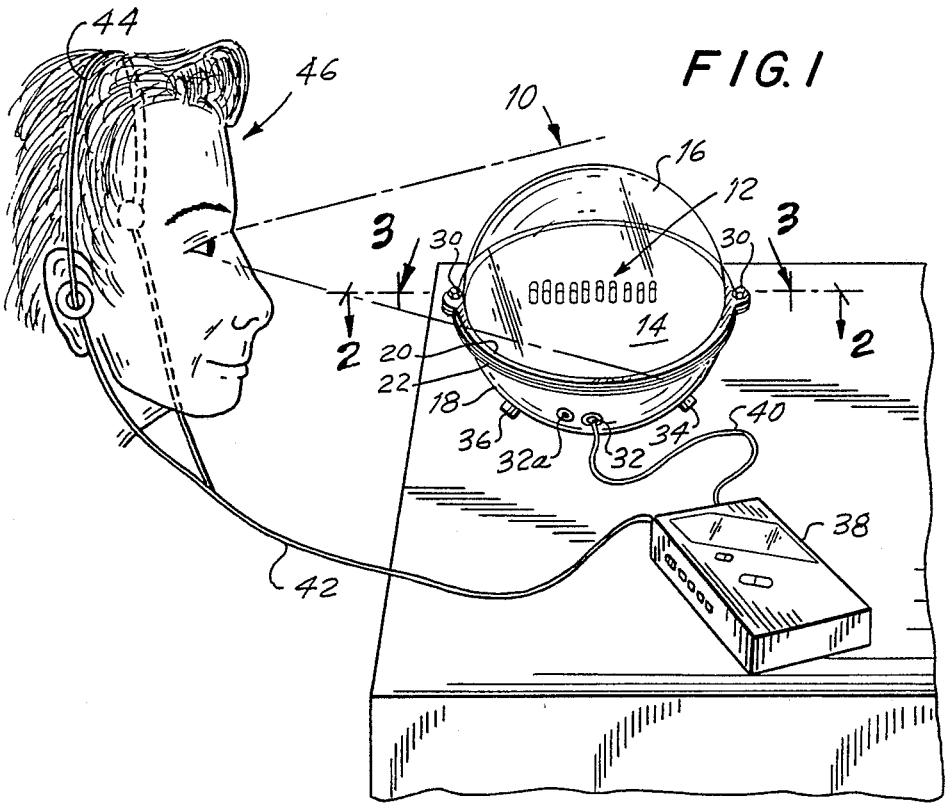
FIG. 1 is a perspective view of an apparatus embodying the present invention being operated and observed by a user.
Figure 3:
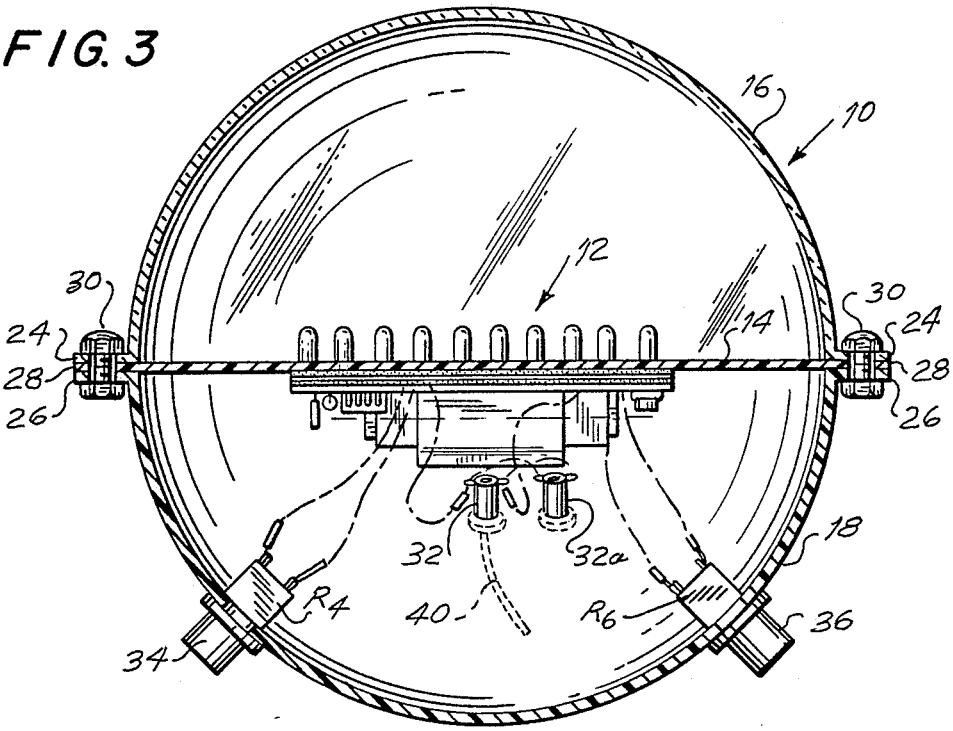
FIG. 3 is a sectional view taken along line 3—3 of FIG. 1, further illustrating the arrangement of the component parts of the invention.
Figure 2:
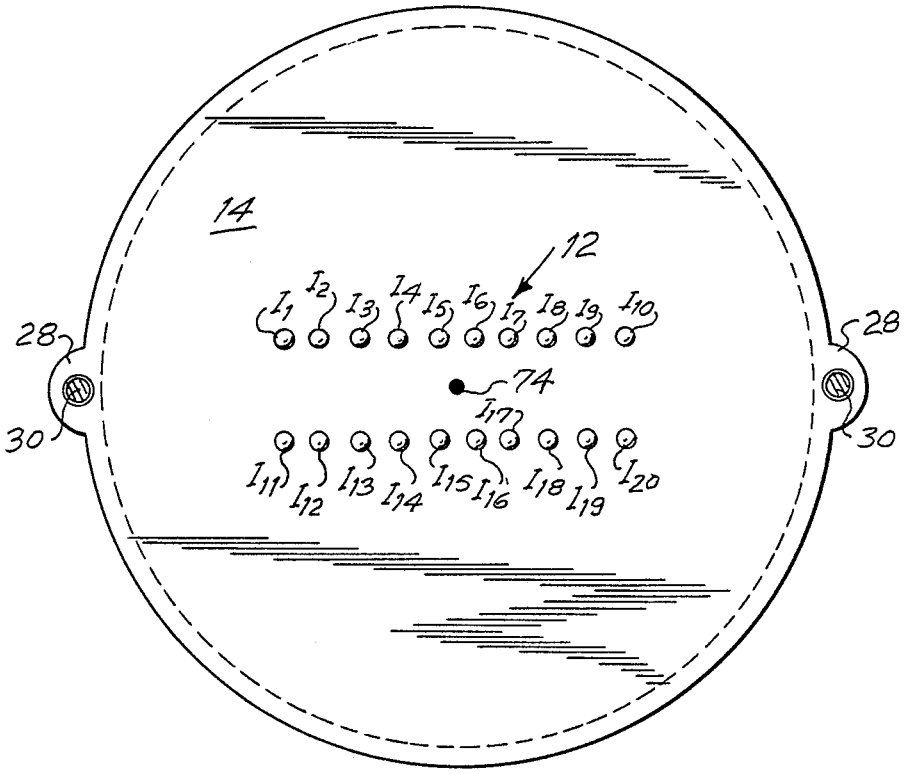
FIG. 2 is a sectional view taken along line 2—2 of FIG. 1, illustrating the alignment of the visual display elements.

Referring initially to FIGS. 1-3, the present invention may be embodied in an apparatus 10 in which visual output display means 12 are mounted on an enclosed, generally circular mounting board 14 affixed between upper and lower hemispherical enclosure elements 16, 18. Mounting board 14, as well as hemispheres 16, 18 may be formed of an appropriate plastic type material, with upper hemisphere 16 being generally transparent and lower hemisphere 18 and mounting board 14 being opaque. Upper and lower hemispheres 16, 18 are each provided with peripheral lips 20, 22, respectively, having pairs of opposed bolt-accepting portions 24, 26. Mounting board 14 is of circular configuration, is adapted to be affixed between lips 20, 22, and similarly is provided with a pair of bolt-accepting portions 28 which may be aligned with corresponding portions 24, 26 of the hemispheres. A pair of bolt and nut units 30 extend through appropriately sized bores to hold the assembly together.

A pair of parallel jacks 32, **32*a* may be provided on lower hemisphere 18 to allow an audio source to be connected to the apparatus, while control knobs 34, 36 on the shafts of variable resistors $R_4$ $R_6$ project from lower hemisphere 18 and further serve as support points for the apparatus upon the surface on which it is placed. The audio output of an appropriate source, such as cassette player 38, is electrically joined to the apparatus by leads 40 operatively connected to input jack 32, while a separate pair of leads 42, connect to an earphone unit 44 which allows the user 46 to both listen to music being played by cassette payer 38 while the music serves as the input for the display of visual output display means 12. Alternatively, leads 42 may be connected to jack 32*a*** when the source includes only a single output.

Figure 4:
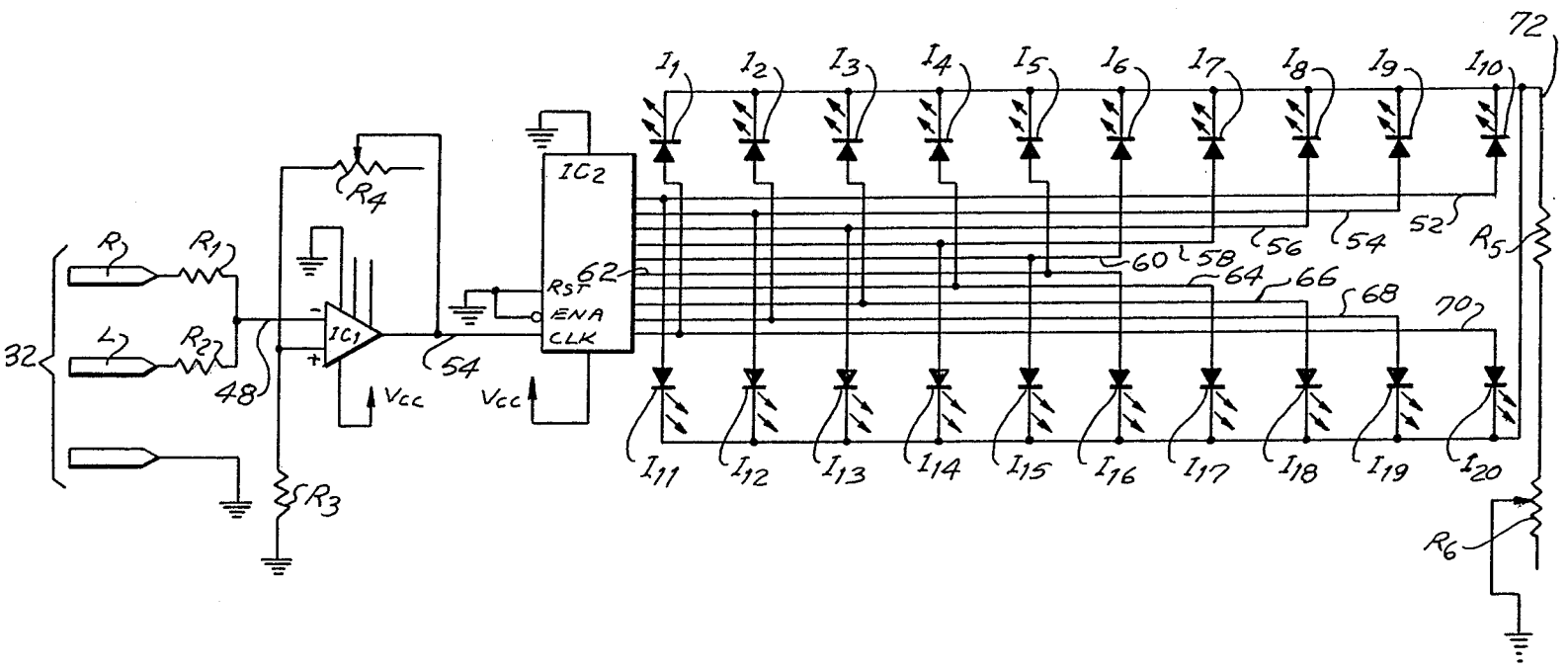
FIG. 4 is a schematic diagram of the circuitry of the present invention.

Referring to FIG. 4, input jack 32, which has provisions for right and left cassette stereo output channels, feeds the audio signals therefrom through resistors $R_1$ and $R_2$ onto line 48 which is coupled to the inverting input of operational amplifier IC-1. Output line 50 from IC-1 directs a portion of the amplified signal through variable resistor $R_4$ to the non-inverting input of IC-1, said input being biased above ground potential by resistor $R_3$ connected between the non-inverting input and ground. Variable resistor $R_4$, creating a feedback loop around IC-1, thus allows the amplification factor of IC-1 to be varied as required.

Amplifier output line 50 also connects the output of IC-1 to the clock input of divider circuitry means IC-2, which may be a digital decade counter. Decade counter IC-2 is wired in its normal configuration such that whenever the input on line 54 rises above the unit's threshold, one of output lines 52–70 is energized. The output lines are energized sequentially, the cycle continuing and repeating for so long as the input signal train includes pulses or segments which rise above the input threshold level.

Each of output lines 52–70 is electrically coupled to a light output display means, which may preferably comprise a series of light-emitting diodes $I_1$–$I_{20}$, aligned along a pair of independent rows or paths, whose anodes are commonly connected to system ground by line 72 through resistor $R_5$ and variable resistor $R_6$. The light-emitting diodes $I_1$–$I_{20}$ may advantageously be aligned in two parallel rows of ten diodes each, as may be seen in FIG. 2. The cathodes of the diodes are paired for electrical connection to counter output lines 56–74. The diodes are paired such that diametrically opposed diodes are connected to the same output line. In other words, $I_1$ and $I_{20}$ are electrically connected to output line 70, $I_2$ and $I_{19}$ are connected to output 68, $I_3$ and $I_{18}$ are connected to output 66, etc. Outputs 52–70, which represent sequential output as counter IC-2 counts input pulses from 0 to 9 on a repetitive basis, thus sequentially activate pairs of diodes, creating the appearance of oppositely traveling synchronous motion along the two lines of diodes which form output display 12.

As seen in FIG. 2, the individual light-emitting diodes $I_1$ to $I_{20}$ may be mounted to the upper surface of mounting board 14, with the remaining circuitry being mounted below the board. A dot 74, which may be painted or otherwise affixed to the upper surface of mounting board 14, is centrally located between the two lines of diodes and may serve as a visual focal point for the user. The power supply for the unit, which may take the form of a 9 volt battery, may similarly be mounted in the lower hemisphere of the device.

The circuit shown in FIG. 4 may be assembled from the following components:

$R_1$—22K ohm
$R_2$—22K ohm
$R_3$—10K ohm
$R_4$—100K ohm variable
$R_5$—220 ohm
$R_6$—5K ohm variable
IC-1—LM 741 operational amplifier
IC-2—4017 Johnson decade counter
$I_1$–$I_{20}$—low voltage light-emitting diodes
$V_{cc}$—9 volts In operation, the display unit is turned on, which may be by means of an appropriate switch (not shown) integral with variable resistor $R_6$, and an appropriate audio signal provided through input jack 32. The level of illumination of diodes $I_1$–$I_{20}$ is adjustable by variable resistor $R_6$, while variable resistor $R_4$ serves as a sensitivity control. This control should be adjusted so that the input signal does not overload amplifier IC-1. When properly adjusted, the amplified signal provided on line 54 to decade counter IC-2 is of an amplitude in which the rhythm and higher volume passages of the signal source clock the counter and thus sequentially energize the light-emitting diodes. At the same time the display is observe, user 46 may listen to the audio source through earphones 44. It has been found that the combination of aural and visual stimuli provided when the apparatus 10 is utilized with certain musical passages allows the user to achieve a stress-free state, a condition substantially different from the state normally achieved by utilization of a conventional "color organ". In particular, use of the musical composition, The Song Inside, copyright 1986 by David Forrest, has been found to stimulate the listener's state of mind in a positive way.

It is to be recognized that variations, modifications and substitutions to the invention as specifically described herein may be available to those skilled in the art, and that such changes, modifications and substitutions are intended to fall within the scope of the present invention as defined by the claims. For example, with appropriate switching circuitry a variety of light sources may be utilized in place of light-emitting diodes $I_1$–$I_{20}$.

I claim:

1. A sound-responsive display apparatus, comprising audio signal input means; an audio frequency responsive amplifier having an input and output, the input of said amplifier operatively connected to said audio signal input means; a divider circuit means having an input terminal and a plurality of output terminals sequentially and individually enabled in response to receipt by said input terminal of a signal train having portions exceeding a given threshold level, said input terminal operatively connected to said amplifier output; and a series of light output display means operatively connected to each of said output terminals whereby an individual display means is activated upon enablement of the output terminal to which it is coupled, each of said light output display means comprising first and second display devices, said first and second display devices of each of said light output display means being aligned along two straight and parallel independent paths in opposed order along said paths.

2. The apparatus of claim 1, wherein said display devices are uniformly disposed along said rows.

3. The apparatus of claim 2, wherein said divider circuitry means is a decade counter and said display devices are light-emitting diodes.

4. A sound-responsive display apparatus for use in conjunction with an audio source in inducing a stress-free state of mind in the user, comprising a generally spherical case formed of upper and lower hemispherical sections, the upper section being essentially transparent and the lower section being opaque; a circular mounting board mounted within said case along the plane defined by the intersection of said upper and lower hemispheres; a series of output display means mounted on said mounting board in two straight and parallel independent paths within said upper hemisphere; a divider circuit means having an input terminal and a plurality of output terminals sequentially and individually activated in response to receipt by said input terminal of a signal train having portions exceeding a given threshold level, said output terminals being operatively connected to said display means whereby pairs of individual display elements on said independent paths are sequentially activated in an opposed order; and means for providing an audio input for activating said plurality of output terminals, said input means operatively connected to the input of said divider means, said divider circuit means and audio input means being mounted within said spherical case.

5. The apparatus of claim 4, wherein said output display means includes a variable resistor to adjust the brightness of said output display means and said audio input means includes an amplifier having a gain control.

6. The apparatus of claim 5, wherein said variable resistor and gain control each have a knob-bearing shaft projecting through said lower hemispherical section whereby said apparatus is at least partially supported upon a mounting surface by said knobs.

* * * * *